US005388523A

United States Patent [19]

Rossmann

[11] Patent Number: 5,388,523

[45] Date of Patent: Feb. 14, 1995

[54] RELEASABLE SABOT FOR A FIN-STABILIZED SUBCALIBER PROJECTILE

[75] Inventor: Rudolf Rossmann, Bulach, Switzerland

[73] Assignee: Oerlikon-Contraves Pyrotec AG, Zurich, Switzerland

[21] Appl. No.: 228,385

[22] Filed: Apr. 15, 1994

[30] Foreign Application Priority Data

May 13, 1993 [CH] Switzerland ..... 01453/93

[51] Int. Cl.[6] ..... F42B 14/06

[52] U.S. Cl. ..... 102/521

[58] Field of Search ..... 102/520–523, 102/532

[56] References Cited

U.S. PATENT DOCUMENTS

| | | | |
|---|---|---|---|
| 4,187,783 | 2/1980 | Campoli et al. | 102/521 |
| 4,382,411 | 5/1983 | Ambrosini | 102/523 |
| 4,424,748 | 1/1984 | Schiff | 102/523 |
| 4,517,899 | 5/1985 | Haberli | 102/521 |
| 4,747,191 | 5/1988 | Montier et al. | 102/521 |
| 4,815,682 | 3/1989 | Feldmann et al. | 102/521 |
| 4,833,995 | 5/1989 | Götz | 102/521 |
| 4,901,646 | 2/1990 | Feldmann et al. | 102/521 |

FOREIGN PATENT DOCUMENTS

| | | | |
|---|---|---|---|
| 0300373 | 1/1989 | European Pat. Off. . | |
| 3525854 | 1/1989 | Germany . | |
| 4009220 | 9/1991 | Germany | 102/521 |
| 4020404 | 1/1992 | Germany | 102/521- |
| 675769 | 10/1990 | Switzerland | 102/523 |
| 2027855 | 2/1980 | United Kingdom . | |
| 2241309 | 8/1991 | United Kingdom | 102/521 |

*Primary Examiner*—Harold J. Tudor
*Attorney, Agent, or Firm*—Sandler, Greenblum & Bernstein

[57] ABSTRACT

In subcaliber projectiles at discharge, a sabot is located between the inner wall surface of the cannon and the fin-stabilized projectile, wherein the sabot, which in a known manner serves to increase the acceleration area, is comprised of a sabot body and a sabot jacket, wherein, in order that upon exit of the projectile from the weapon barrel, the sabot can readily detach itself from the subcaliber projectile, the sabot is segmented, with the contact areas between segments on one side and between the subcaliber projectile and segments on the other side leading to sealing problems, which are overcome, in accordance with this invention, via a special segmentation of the sabot body, with longitudinal slots which include at least, in part, a T-shaped cross section, and reference fracture locations in the region of its inner diameter as well as a gas-tight seal with a concave shaped forwardly-widening seal bonnet having a closing seal.

8 Claims, 3 Drawing Sheets

18
12
11
10
19
20
33
38
48
III
III
15
39
17
32
34
31
25
30
16
22
29
14
49
28
27
IV
IV
50
40
26
41
21
43
A
42
13

RELEASABLE SABOT FOR A FIN-STABILIZED SUBCALIBER PROJECTILE

BACKGROUND OF THE INVENTION

1. Field of the Invention

This invention pertains to a releasable or jettisonable sabot or cartridge-case base for a fin-stabilized subcaliber projectile which is capable of being fired from a weapon barrel having rifled or helical grooves wherein the sabot jacket is preferably made of a plastic material and the sabot body consists of light metal. The sabot body, in turn, is subdivided into segments and includes a cartridge shell attachment place or portion.

2. Discussion of the Background of the Invention and Material Information

In a known or prior art fin-stabilized subcaliber projectile of this type, as exemplified by European patent publication EP-A-0 300 373 as well as cognate U.S. Pat. Nos. 4,815,682 and 4,901,646, the three segments of the sabot body or the sabot tail are held together via a sabot jacket (called sabot body in the noted publications). For sealing the adjoining or abutting areas between the three segments, these abutting areas have canals or channels which contain or are filled with sealing strips. For sealing of the abutting areas between the subcaliber projectile or fin-stabilized projectile and the three segments of the sabot tail or sabot body, a ring-shaped seal is utilized in the area of the rear face or end plane of the sabot tail. This rear face forms or constitutes the acceleration portion. Experience has shown that this known joint or seal is insufficient and must be improved.

In addition, described in Swiss patent publication CH-675 769 A5 is a sabot projectile having a reference fracture location or predetermined breaking point in the rear section of the sabot, wherein the rear section includes longitudinal slots for the segmentation thereof and further includes a ring having such fracture locations in the region of the outer diameter thereof. At the rear end of the sabot aft section, a hemispherical sealing shell is provided for the sealing of the propellant gas. In order that the aft portion of the sabot does not prematurely separate into its sectors during firing, that is, in order to neutralize the outwardly radially-acting gas pressure that acts on the sealing shell, jointly acting support surfaces are provided at the sabot rear or aft section and at the rear end plane of the projectile body. This is not possible in the class or genus of the present application.

In a further known fin-stabilized projectile of this type, such as that shown in German patent publication DE-A-35 25 854 the sabot is comprised of a jacket in front, a sabot body in the middle, and a sealing disk at the rear. Since the sealing disk and jacket are not combined or joined in a gas-tight manner, and since there is no closing seal, a satisfactory gas seal cannot be assured at discharge.

The task or object of the present invention is to so improve the seal or joint that upon firing an absolutely reliable gas seal is achieved between the cannon barrel and the sabot, without being influenced by the wear of the cannon barrel during its life span.

SUMMARY OF THE INVENTION

The object or purpose of this invention is achieved via a releasable sabot for use in a fin-stabilized subcaliber projectile that is capable of being fired from a helically grooved or rifled gun barrel, the sabot having a sabot body, the subcaliber projectile being anchored in the sabot body, the sabot body being subdivided into segments and including a cartridge shell attachment place and having an acceleration portion at the rear end thereof; a sabot jacket which is divided into segments as well as at least, in part, surrounding and penetrating the subcaliber projectile and the sabot body; the sabot body, for the purpose of segmentation and gas-tight sealing, further including longitudinal slots and a reference fracture location, in a manner, that the reference fracture locations are arranged in the region of the inner diameter of the sabot body at the acceleration portion of the sabot body, the longitudinal slots including, in the region of the cartridge shell attachment place, a T-shaped cross section with two shoulders as additional sealing areas for the material of the sabot jacket residing in the longitudinal slot, as well as the acceleration portion of the sabot body having a concave-shape with a forwardly-widening jacket area; and the sabot jacket including a closing seal and a shaped seal bonnet functioning jointly with the acceleration portion of the sabot body.

Specifically, the acceleration portion includes an outwardly-turned spherically-formed face and a seal bonnet, with a thrust ring being located at the sabot body for the outer support of the seal bonnet.

In addition, the closing seal includes a ring-shaped rib which extends into an axial safety groove of said sabot body.

Furthermore, the subcaliber projectile includes a thread and a smooth cylindrical surface, the closing seal extending partially along the thread and further extending partially along the surface adjacent to the thread.

Preferably, the portion of the closing seal adjacent to the thread is constructed as a rearwardly extending cylindrical portion.

In new cannon barrels the sabot jacket is held together with the sabot body via the cannon barrel in such a way that a reliable seal is assured between the subcaliber projectile body, that is between a fin-stabilized projectile body and the sabot. In old or used cannon barrels, wherein the inner diameter of the barrel has increased due to wear or usage, the danger exists that upon discharge, the segments of the sabot will move radially outwardly and that those segments will then no longer remain adjacent to the fin-stabilized projectile body so that gas can escape between the sabot and the fin-stabilized projectile body. This is now prevented or precluded via the forwardly widening jacket area of the sabot jacket covering at the rear end plane of the sabot, preferably via the outwardly turned spherical-shaped jacket area of the sealing cap or bonnet as well as through the T-shaped longitudinal slots in the region of the cartridge shell attachment place. Due to the special form or shape of the shell as well as the T-shaped longitudinal slots, the gas pressure endeavors to press the individual segments of the sabot base or body against the body of the fin-stabilized projectile, such that a reliable gas seal is assured between the subcaliber projectile, that is the subcaliber projectile and the sabot.

Through the formation or construction of the sabot as set forth in the claims to follow, preferably with a spherically-shaped sealing cap, as claimed, the following advantages are achieved:

a) No gas leakage at discharge or firing, that is, better gas sealing of the sabot during movement of the projectile within the cannon barrel;

b) the gas pressure can press the sabot against the body of the fin-stabilized projectile, so that a satisfactory discharge is assured in old cannon barrels;
c) since, as noted, the sabot fits better relative to the body of the fin-stabilized projectile, the danger of fractures of the projectile is reduced;
d) due to the improved gas seal, particularly through the T-shaped longitudinal slots, sealing during storage and transport, relative to the powder chamber, is improved;
e) in spite of the improved gas sealing, the reference fracture locations or predetermined breaking points between the individual segments are small, such that upon exit of the projectile, the sabot is easily separated into segments without impairing the flight path of the fin-stabilized projectile, thus achieving good accuracy; and
f) the production of the sabot is simplified and cost-effective.

The unitary or single piece sabot jacket is comprised of the following continuous parts:

a) a projectile centering in front and rotational transfer or spin propagation with a projectile centering in the rear and anchoring at the sabot body;
b) the sealing of the longitudinal slots of the sabot body, particularly in the area of the cartridge shell attachment place; and
c) a seal bonnet at the rear face of the sabot body, which is designated as the acceleration portion, and an integrated closing seal.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
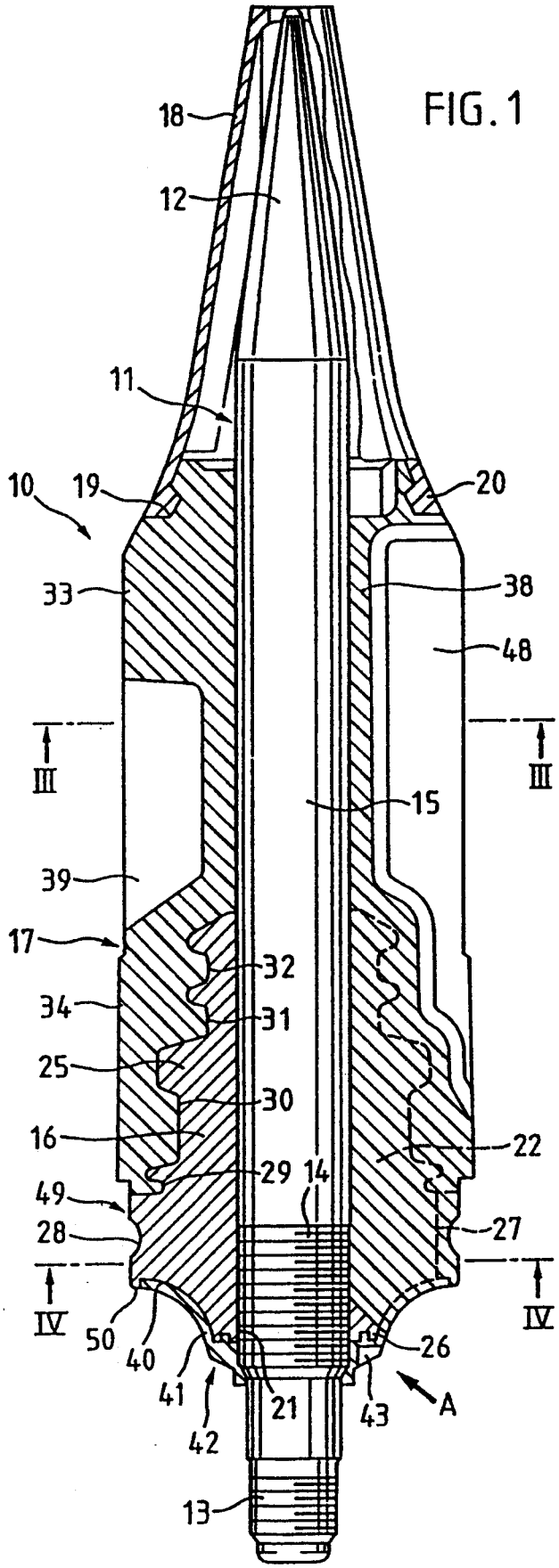
FIG. 1 is a longitudinal section, taken along line I—I of FIG. 3, through a releasable sabot for a fin-stabilized subcaliber projectile.

FIG. 1 shows the use of a sabot 10 in a subcaliber projectile, particularly a fin-stabilized projectile 11. Fin-stabilized projectile 11 includes a tip 12 in front and a rear thread 13 for the attachment of a known, non-illustrated stabilizing fin. Sabot 10 is attached to fin-stabilized projectile 11 with a second outer thread 14 on middle portion 15 of fin-stabilized projectile 11. Since fin-stabilized projectile 11 is not the subject of the present invention, it will not be described in more detail hereinafter.

Sabot 10 is comprised of sabot base or body 16 and sabot jacket or covering 17. A projectile tip 12, on the front end of the fin-stabilized projectile 10, is enclosed with a cover 18. Sabot jacket 17 includes a circumferential groove 19, also shown in FIG. 2, which receives a bead 20 that secures cover 18 to sabot jacket 17.

Figure 4:
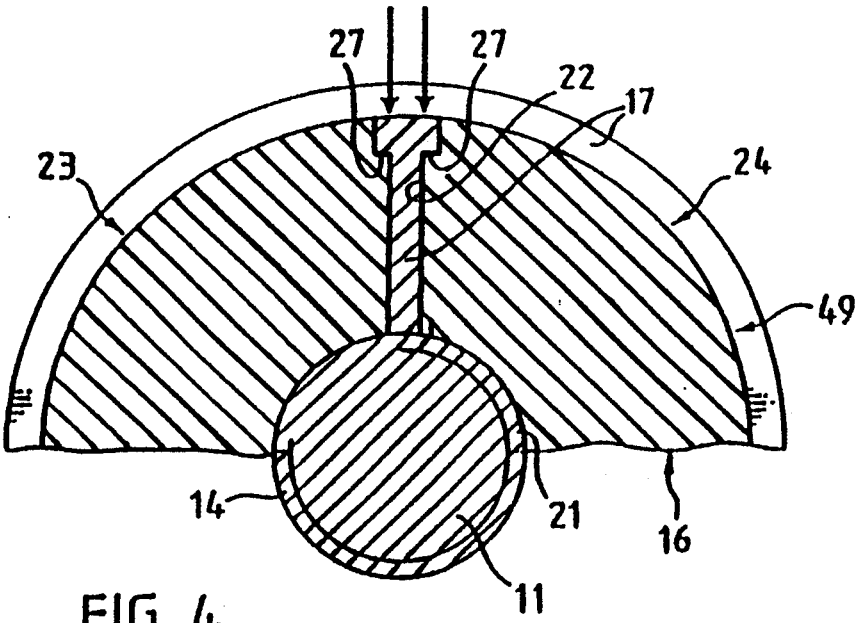
FIG. 4 is an enlarged partial cross section through the sabot, taken along line IV—IV of FIG. 1, however rotated 90 degrees relative to FIG. 2.
Figure 5:
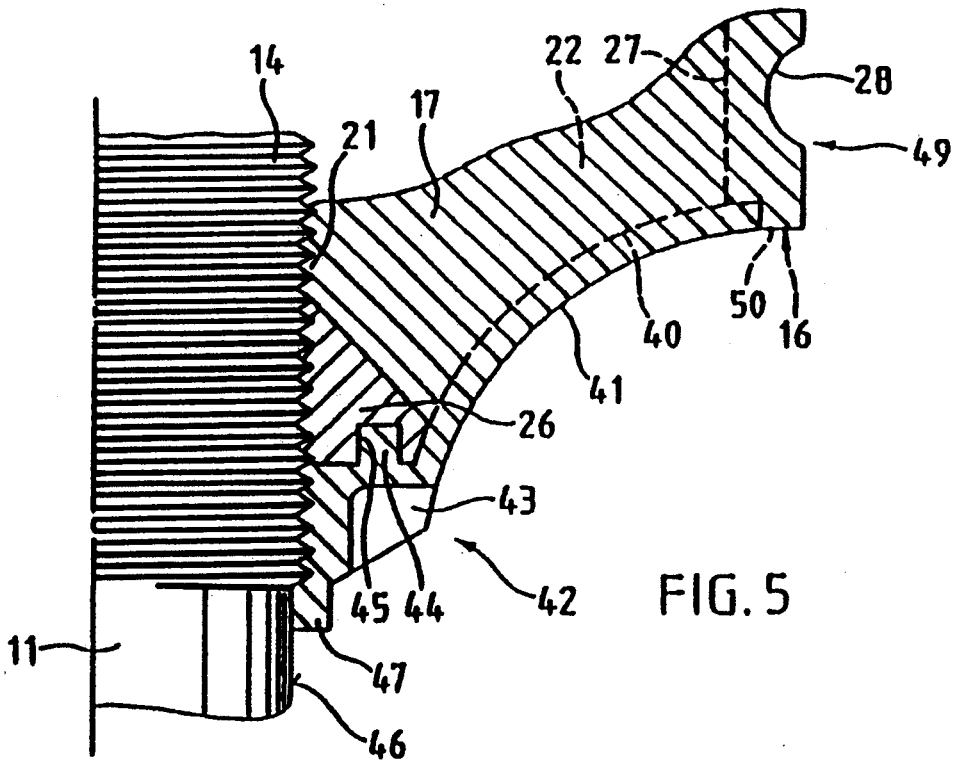
FIG. 5 is an enlarged detail of FIG. 1 viewed in the direction of arrow A thereof.

Sabot body 16 includes an inner thread 21 which is threaded onto outer thread 14 of fin-stabilized projectile 11. Moreover, sabot body 16 includes three equally circumferentially spaced longitudinal slots or grooves 22, only one of which is shown in each of FIGS. 1, 2, 4, and 5. FIG. 1 indicates a longitudinal slot 22 in sabot base or body 16 on the right hand portion of the figure via a broken line wherein the sabot jacket material fills longitudinal slot 22. It is via these longitudinal slots 22 that sabot body 16 is subdivided into three segments 23, 24, and 25. FIG. 4 shows two segments 23 and 24 with FIG. 1 showing a further segment 25. These three segments 23, 24, and 25 according to FIGS. 1 and 5, are connected together via reference fracture location or predetermined break points 26. These reference fracture locations 26 are, in accordance with this invention (see FIG. 1) arranged or disposed at the rear end in the region of the inner diameter of sabot body 16 in order to prohibit a premature, undesired breaking up, via the pressure of the propellant gases, during firing. The three longitudinal slots 22 are radially arranged and have, in accordance with the invention, at least in the region of the cartridge shell attachment place 49, a T-shaped cross section which has two shoulders 27, as best shown in FIGS. 1, 4, and 5 whose function will be described hereinafter. In addition, sabot body 16 includes a quantity of peripheral grooves. Starting from the lower or rear end of sabot body 16, first peripheral groove 28 serves for the attachment of a cartridge shell to the sabot projectile or for anchoring the sabot projectile to a non-illustrated cartridge shell. The additional four peripheral grooves 29, 30, 31, and 32 serve for the fastening of sabot jacket 17 to sabot body 16. The significance of these grooves 29–32 need not be discussed in more detail. Sabot body 16 is preferably fabricated from a light metal.

Sabot jacket 17, which is deemed to be of considerable importance in this invention, almost completely surrounds sabot body 16. According to FIGS. 1, 2 only the areas of the cartridge shell attachment places 49, not interrupted by the three longitudinal grooves 22, together with peripheral groove 28, which serves for the attachment of the projectile to a non-illustrated cartridge shell, together with the three adjacent segments of a thrust ring 50, extend from sabot jacket 17. Sabot jacket 17 includes a front portion 33 which is designated as a front centering device, as well as a rear portion 34 which is designated as a rear centering device and at the same time serves as a rotational transfer or spin propagation mechanism and thus has a somewhat greater diameter than front portion 33. According to FIG. 3, sabot jacket 17 includes three longitudinal slots 48 through which sabot jacket 17 is also subdivided into three segments 35, 36, and 37. These three segments 35, 36, and 37, according to Figs. 1 and 3, are connected with each other via reference fracture locations 38. The length of these reference fracture locations can be seen in FIG. 1. In addition, sabot jacket 17 includes six recesses 39 that is, each of the three segments 35, 36, and 37 includes two recesses 39 as best seen in FIG. 3. The rear face or end plane 40 of sabot body 16, except for the three segments of the thrust ring 50, is covered with a seal bonnet 41 of sabot jacket 17. This face or rather frontal area 40 is partially concave with a, forwardly-widening jacket area, whereby the generatrix of the concave-shaped forwardly-widening jacket area is preferably formed via a circular arc having its center in the region of the outer diameter of sabot 10, in other words, the rear face 40 forms an outwardly turned spherically shaped support or seat for corresponding jointly acting forward sealing cap or bonnet 41. In this manner, the pressure of the propellant gases, during firing, functions to assist in sealing.

Figure 2:
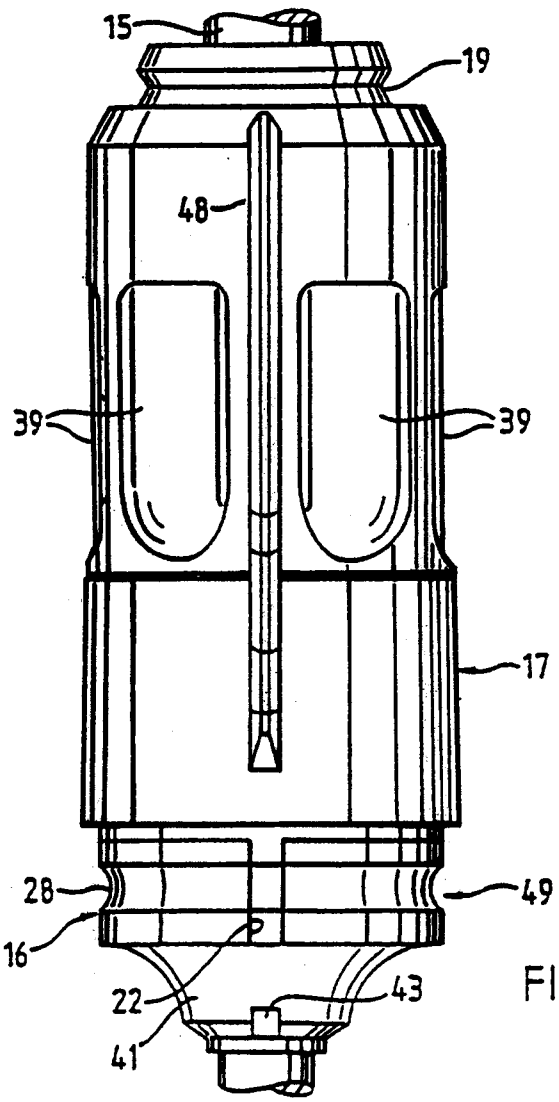
FIG. 2 is a view of a portion of the sabot of FIG. 1 with a portion of the projectile however rotated 90 degrees relative to FIG. 1.
Figure 3:
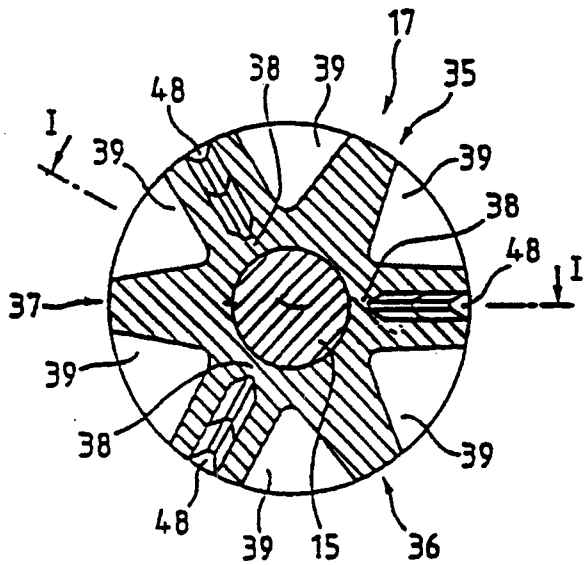
FIG. 3 is a cross section through the sabot, taken along line III—II of FIG. 1.

According to FIG. 5, seal bonnet 41 includes a ring-shaped closing seal 42 which utilizes three equally peripherally spaced reference fracture locations 43, as best seen in FIG. 2. In addition, a ring-shaped rib 44 extends into a corresponding axial safety groove 45 at the rear end of sabot body 16. Furthermore, closing seal 42 lies partially along thread 14 of subcaliber projectile 11 and extends axially beyond this thread and extends as a cylindrical segment 47 partially along cylindrical surface 46. During discharge the seal bonnet 41 and its closing seal 42 are pressed, via gas pressure, both radially and axially against the body of the fin-stabilized projectile. In order to prohibit the movement or dislocation of seal bonnet 41, shown in broken lines in FIG. 5, to the outside, via gas pressure, sabot body 16 includes a thrust ring 50 for the outer retention or support of seal bonnet 41.

According to FIG. 4, the already mentioned shoulders 27 in longitudinal slots or notches 22 between segments 23, 24, and 25 of sabot body 16, have the particular task to act as additional sealing areas for sealing in the region of the cartridge shell attachment area 49 against the gas pressure during discharge or firing of the projectile, since the gas pressure presses the material residing in longitudinal slots 22 of sabot jacket 17 against shoulder 27, with the gas pressure, as shown by arrow B, acting radially to the inside. In addition thereto, this also ensures the sealing between the sabot projectile and the powder chamber also during storage and transport, particularly in cooperation with the sealing fluid used during munitions assembly.

While there are shown and described present preferred embodiments of the invention, it is to be distinctly understood that the invention is not limited thereto, but may be otherwise variously embodied and practiced within the scope of the following claims.

What is claimed is:

1. A releasable sabot in combination with a fin-stabilized subcaliber projectile that is capable of being fired from a helically grooved weapon barrel, said sabot comprising:

a sabot body, said fin-stabilized subcaliber projectile being anchored in said sabot body, said sabot body being subdivided into segments and including a cartridge shell attachment place and said sabot body having an acceleration portion at a rear face thereof;

a sabot jacket which is divided into segments and at least partially surrounding both a central portion of the fin-stabilized subcaliber projectile in front of the sabot body and the sabot body;

the sabot body, for the purpose of segmentation and gas-tight sealing, further including longitudinal slots and reference fracture locations, wherein the reference fracture locations are arranged in a region of the inner diameter of the sabot body at said acceleration portion of the sabot body, said longitudinal slots including, in the region of the cartridge shell attachment place, a T-shaped cross section with two shoulders as additional sealing areas for the material of the sabot jacket residing in the longitudinal slot, with said-acceleration portion of the sabot body having an outwardly facing forwardly- widening jacket area; and the sabot jacket including a seal bonnet having a ring-shaped closing seal shaped for cooperating with said acceleration portion of the sabot body.

2. The sabot of claim 1 wherein said acceleration portion of the sabot body includes an outwardly-turned spherically-formed face and a thrust ring at an outer end of said spherically-formed face for the outer support of said cooperating seal bonnet of the sabot jacket.

3. The sabot of claim 1 wherein said ring-shaped seal includes a ring-shaped rib which extends into an axial safety groove of said sabot body.

4. The sabot of claim 2 wherein said ring-shaped closing seal includes a ring-shaped rib which extends into an axial safety groove of said sabot body.

5. The sabot of claim 3 wherein said subcaliber projectile includes a thread and a smooth cylindrical surface, said ring-shaped closing seal extending partially along said thread and further extending partially along said surface adjacent to said thread.

6. The sabot of claim 4 wherein said subcaliber projectile includes a thread and smooth cylindrical surface, said ring-shaped closing seal extending partially along said thread and further extending partially along said surface adjacent to said thread.

7. The sabot of claim 5 wherein the portion of said ring-shaped closing seal adjacent to the thread is constructed as a rearwardly extending cylindrical portion.

8. The sabot of claim 6 wherein the portion of said ring-shaped closing seal adjacent to the thread is constructed as a rearwardly extending cylindrical portion.

* * * * *